United States Patent [19]

Deeter et al.

[11] 4,264,106

[45] Apr. 28, 1981

[54] AUGER MINING MACHINE

[75] Inventors: Ronald C. Deeter, Malvern; Thad A. Lora, Salem; Warren E. Kelm, Lisbon, all of Ohio

[73] Assignee: The Salem Tool Company, Salem, Ohio

[21] Appl. No.: 35,989

[22] Filed: May 4, 1979

[51] Int. Cl.[3] ..... E21C 1/00; E21C 9/00

[52] U.S. Cl. ..... 299/56; 299/80; 299/88; 175/85; 175/88

[58] Field of Search ..... 299/55, 56, 80, 87; 175/171, 88, 85

[56] References Cited

U.S. PATENT DOCUMENTS

| | | | |
|---|---|---|---|
| 2,764,397 | 9/1956 | Compton | 175/88 |
| 2,935,309 | 5/1960 | McCarthy | 299/55 |
| 3,091,439 | 5/1963 | Adams et al. | 175/85 X |
| 3,746,110 | 7/1973 | Young | 299/56 |
| 4,021,076 | 5/1977 | Hawthorne | 299/56 |

*Primary Examiner*—William F. Pate, III

*Attorney, Agent, or Firm*—Pearne, Gordon, Sessions, McCoy & Granger

[57] ABSTRACT

An auger machine, such as a mining machine, embodying features that reduce the cost of mining. The machine embodies jacks and skids which permit ready maneuverability of the machine adjacent the wall containing the seam to be mined, and has a cross conveyor for conducting away mined material from the auger string, which cross conveyor is located rearwardly of the front jacks and thus facilitates placing of auger sections in and removing auger sections from the string of augers used in mining by an efficient

19 Claims, 18 Drawing Figures

AUGER MINING MACHINE

BACKGROUND OF THE INVENTION

This invention relates to auger apparatus of the type that bores deep, laterally extending holes into mineable material in the earth by an auger formed of a string of connected, helically vaned sections, and more particularly to such apparatus providing lower costs of manufacture, increased flexibility, speed and efficiency of operation, and lower cost of transportation and placement of the machine.

The invention provides exceptional advantages when employed in auger mining machines of the type adapted to be positioned adjacent an upwardly extending wall to recover material to be mined from a seam of mineable material such as coal that is exposed in such wall and extends generally laterally into the earth. Therefore, for convenience, the invention will be discussed in connection with such a machine for mining coal, although it may be applicable to other types of auger apparatus.

Auger mining machines of this type comprise an auger embodying a cutting head suitable to the thickness of the coal seam connected to and rotatably driven by a string of endconnected, helically vaned auger sections driven from the machine by being rotated and urged longitudinally of the auger. The cutting head penetrates the coal seam, and the mined coal is transported rearwardly from the cutting head along the auger string by the vanes of the auger sections out of the hole cut by the cutting head to a conveyor on the machine by which the coal is removed.

As the cutting head is caused to penetrate into the hole, it is necessary to introduce auger sections into the string until the desired length of the auger string is reached to achieve the desired depth of hole. After the cutting head has penetrated to the desired depth of hole, it must be withdrawn by removing auger sections until the cutting head is out of the hole. The machine as a whole may then be moved laterally to another position where its auger can drill another hole generally parallel to the previously drilled hole.

The maximum diameter of the auger to be used is largely determined by the thickness of the coal seam, an auger of smaller diameter being used for a thinner seam and an auger of larger diameter being used for a thicker seam. Occasionally, a coal seam that is being mined varies in thickness or in the same wall there are seams of widely varying thickness, or in the locality in which the mining machine is working there are different seams of different thicknesses, so that augers of different diameters should be used for maximum recovery of coal.

It is desirable that a single machine be capable of handling and driving augers of different diameters in order to permit maximum utilization of the machine and maximum recovery of the coal with the single machine without the necessity of bringing in other machines. For a given power output of an auger machine, it is also most desirable that the machine be capable of driving an auger of as large a diameter as feasible.

Moreover, in order to achieve the desired high production, it is necessary rapidly and accurately to handle the auger sections in taking them from a store of sections and placing them in the auger string as the hole is bored, and then in removing the auger sections from the auger string as the auger is withdrawn from the hole. The auger sections are quite heavy, often weighing several hundred pounds or more, particularly those of large diameter. It is desirable that the sections be rapidly lifted and put in place accurately longitudinally and rotationally in the auger string to enable them to be connected preferably automatically to the driving means on the auger machine and to other auger sections in the string when the auger sections are being placed in the string; and to be lifted from and removed from the auger string when necessary after the auger sections are disconnected, preferably by remote control from the driving means and from other auger sections.

Because of the size and weight of the auger sections, they must be handled by mechanical hoist means. The hoist means should be such that it can carry out the above functions rapidly and without danger to an operator. It is important that the operator closely observe the position of the auger section or sections being handled by the hoist means while he is controlling the hoist means to handle the auger sections rapidly and accurately, but that in doing so the operator remain in a safe place free of any danger of being struck by an auger section being moved by the hoist means.

Furthermore, heretofore it has been usually necessary to use at least two operators to handle movement auger sections, one operator controlling the handling of the auger section between an auger string on the machine and the store of auger sections, and another operator being used in connecting or disconnecting the auger sections, while a third operator on the machine controls the rotation of the drive head and the position of the driving carriage longitudinally of the machine. However, for economical operation it is desirable that fewer operators be used to operate the machine and to handle auger sections.

Furthermore, it is usually necessary to cut a floor in a pit to form an essentially vertical wall containing the coal seam. Because auger machines are generally used to mine coal in seams extending in a hill, the pit is generally cut in the form of a ledge in the side of the hill to expose the coal seam. The cost of cutting a pit is substantial, and recent ecological laws and regulations require that substantial backfilling of the pit be performed after the mining operation is concluded, which provides another substantial additional cost. Consequently, it is advisable that the floor of the pit be as narrow as possible to reduce the amount of initial cutting that should be performed, particularly when as is oftend the case considerable rock is encountered, and also to reduce the cost of backfilling. Consequently, it is desirable that the length of the machine be as short as possible to make possible as narrow a pit floor as possible.

Furthermore, it is usually necessary to move the machine from one location to the other either in a certain field of operation, or over the road to mining locations a considerable distance away. The machine, therefore, should be as light as possible and satisfy weight, width, length, and height limitations for over-the-road transportation and for passing under bridges.

Furthermore, it is desirable that the machine be constructed at a cost as low as feasible, and that it be operated economically, efficiently, and with maximum safety to the operators.

All of these factors are desirable to reduce the cost of mining.

SUMMARY OF THE INVENTION

It is an object of the invention to provide auger machines that overcome the above-indicated disadvantages of prior apparatus and to embody as many as desired of the features summarized above, including machines providing all of such features.

A further object is to provide auger machines that permit the use of augers of a wide range of diameters.

A further object is to provide auger machines that permit rapid placement of auger sections in the auger string and rapid removal of auger sections from the auger string with maximum safety to operators.

A further object is the provision of an auger machine that requires little maintenance and can be manufactured at reasonable cost.

Toward these objects, the invention provides auger apparatus comprising a rigid frame including a generally horizontally and longitudinally extending lower frame portion having a front end and a rear end, the lower frame portion comprising spaced parallel frame members at its sides, power means carried by the lower frame portion adapted to rotate elongated, helically vaned auger means about its axis while it is positioned in an operative location in the apparatus between such frame members, the axis of the auger means extending generally parallel to such frame members, spaced upright members fixed to the lower frame portion near the front end thereof, each of the upright members carrying jack means for raising and lowering the lower frame portion; conveyor means located near the front end of the lower frame portion but rearwardly of the upright members, this conveyor means extending transversely beneath the auger means when it is in place between the frame members of the lower frame portion to receive mined material conveyed to the conveyor means by the auger means as it rotates and to convey such mined material laterally out of said lower frame portion, and means for driving the conveyor means.

In such apparatus, the structure immediately above the part of the upper frame portion at which such conveyor means is located preferably is free of any projection that extends a substantial distance above the remainder of said lower frame portion, so that an auger section moved toward or from the position occupied by said auger means need be lifted only a relatively short distance above said lower frame portion to clear said lower frame portion.

Such apparatus preferably comprises hoist means for moving an auger section toward or away from said auger means, such hoist means being supported near the rear of said lower frame portion and comprising boom means adapted to be moved laterally between a position to be occupied by auger means between the frame members of said lower frame portion and a position outside of said lower frame portion, the boom means carrying cable means suspending auger section engaging means adapted to be raised and lowered by said cable means, and means adapted to shorten and lengthen said cable means to permit said auger section engaging means to be raised and lowered.

The invention also provides auger apparatus comprising a rigid frame including a generally horizontally extending lower portion having a front and rear end, the lower frame portion comprising spaced parallel, generally longitudinally extending frame members and belly means extending transversely between the lower portions of the frame members, carriage means supported by the lower frame portion and adapted to move longitudinally of such frame members, the carriage means including power means and drive means from the power means to a drive head adapted to be connected to and to rotate an auger comprising at least one auger section, which auger is adapted to be supported by the belly means, movable drive means included in the drive means on the carriage means and adapted to carry the drive head and to move the drive head laterally of the carriage means to drive an auger while it is in any of a plurality of positions located laterally of and extending longitudinally of the frame members, guide means adapted to be fixed to the belly means in any of several positions laterally of the belly means between said frame members to guide an auger located in any of such lateral positions between the lower frame members, and movable guide means movable longitudinally of the lower frame portion at the front end thereof to permit the guide means to extend between the lower frame portion and the wall in which the auger is to penetrate, the longitudinally movable guide means including replaceable guide portion means adapted to be placed to fit, support and guide an auger located in any of such different lateral positions.

In such apparatus, the movable drive means preferably is pivotally supported at its upper portion on the carriage about an axis parallel to and substantially offset upwardly and laterally relative to the longitudinal center line of the belly means, the movable drive means including the drive head at its lower portion and being adapted to be moved about such pivot axis to locate the drive head in a plurality of positions laterally of the belly means to accommodate augers of different diameters at different lateral positions relative to the belly means.

BRIEF DESCRIPTION OF THE DRAWINGS

The above advantages, features, and objects will become more clearly apparent from the following description of a preferred embodiment of the invention in connection with the accompanying drawings, in which.

DESCRIPTION OF PREFERRED EMBODIMENT

The illustrated auger machine comprises a rigid main frame 1 that supports and guides an auger A (FIGS. 2, 3) made up of a string of auger sections S, having vanes V, that are connected at their ends in known manner so the sections cannot rotate relative to each other but can be readily disconnected. The auger section at the outer end of the string carries a cutting head C of any suitable known type.

Figure 2:
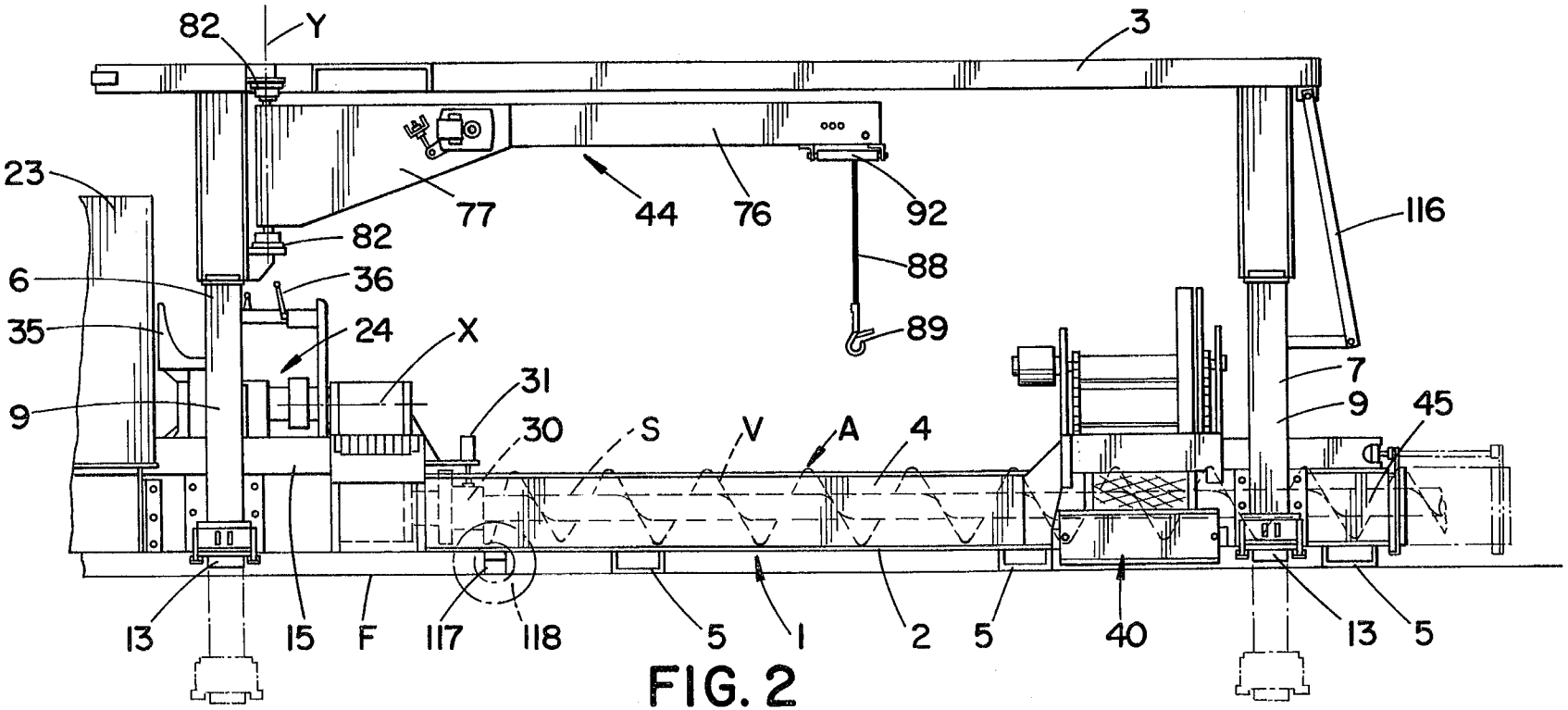
FIG. 2 is a side elevation of the machine of FIG. 1, the rearmost portion being omitted, an auger string, of which a part is shown as broken away, being shown connected to the machine.

Main frame 1 includes rigid lower frame portion 2 and upper frame portion 3. Frame portion 2 comprises a pair of spaced, longitudinally extending massive side frame beams 4 joined by cross members 5 (FIG. 2). Near the ends and in corresponding position on either side, the main frame 1 has fixed to it four rigid upright posts 6 and 7 connecting the upper and lower frame portions 2,3. The lower portion of each post comprises a jack 9, comprising an outer tubular member 10, shown as of substantially square cross section, having a telescoping inner member 11 (FIG. 4) adapted to be moved downwardly from and upwardly into the bottom of member 10 by fluid cylinder 12 to raise and lower frame 1 as required. The lower ends of inner members 11 of the pair of jacks 9 at each end of the machine carry a skid 13 adapted to rest on the pit floor F, and fluid cylinder 14 for causing the skid to more relative longitudinally of the skid, and hence laterally of the members 11 and frame 1, for a predetermined distance within design limits. Members 11 and then skids 13 of jacks 10 can be extended as shown in broken lines in FIG. 2 to lift the main frame and the portions of the machine carried by it free of floor F, and the skids 13 and cylinders 14 can cause the frame to be moved laterally of the frame as desired. By suitable manipulation of the jacks and skids in known manner, it is possible to move the machine laterally, or closer to or further from the wall into which the auger string penetrates, as desired.

Figure 1:
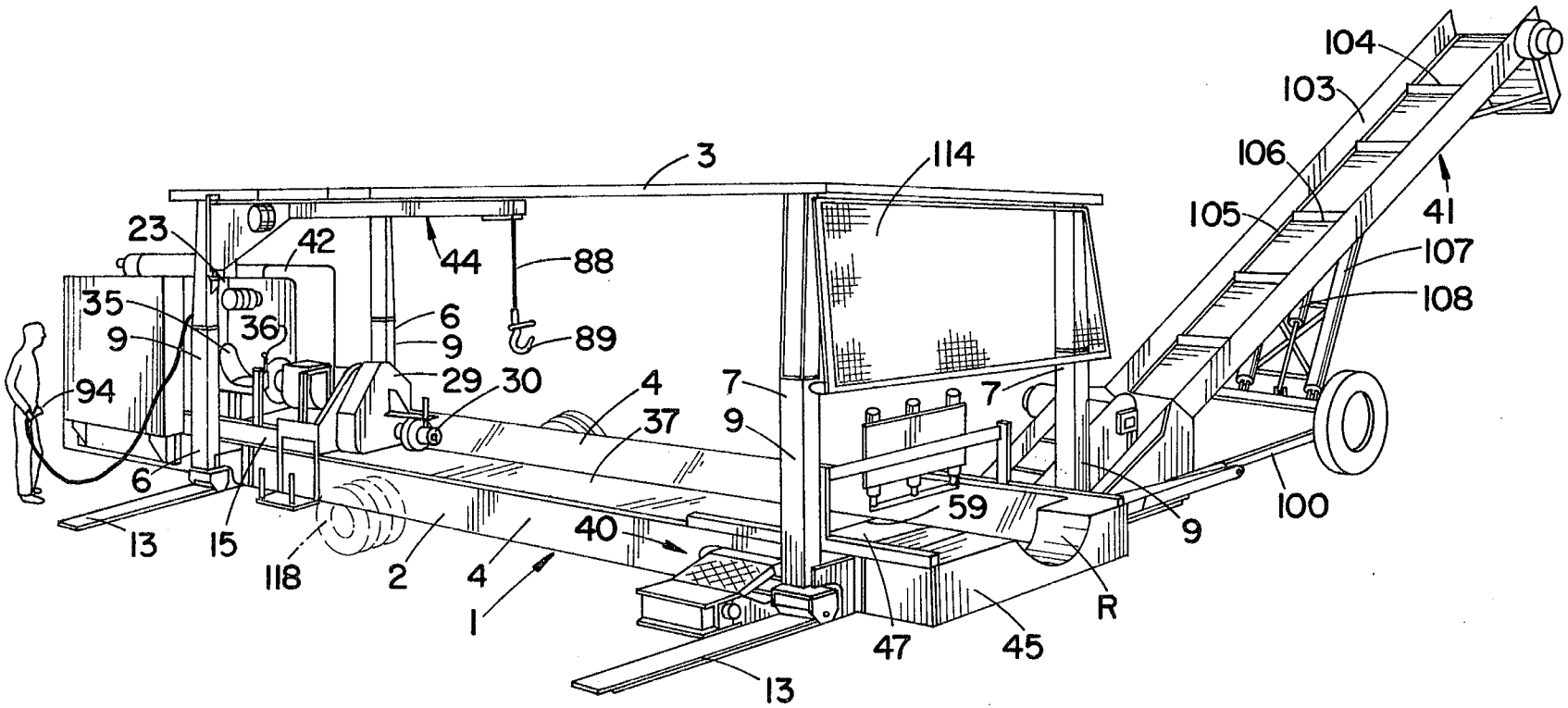
FIG. 1 is a somewhat simplified perspective view of an auger machine embodying the invention, no auger string being shown in the machine.

The skids are made of high strength steel and are so designed that they are of mininum vertical thickness safely feasible for the load to be carried, so that when the skids are retracted, as shown in full lines in FIGS. 1 and 2, the distance between the floor F and the bottom edges of the auger vanes and cutting head is as small as feasible, thus reducing excavation required to provide floor F and expose the coal seam.

Figure 9:
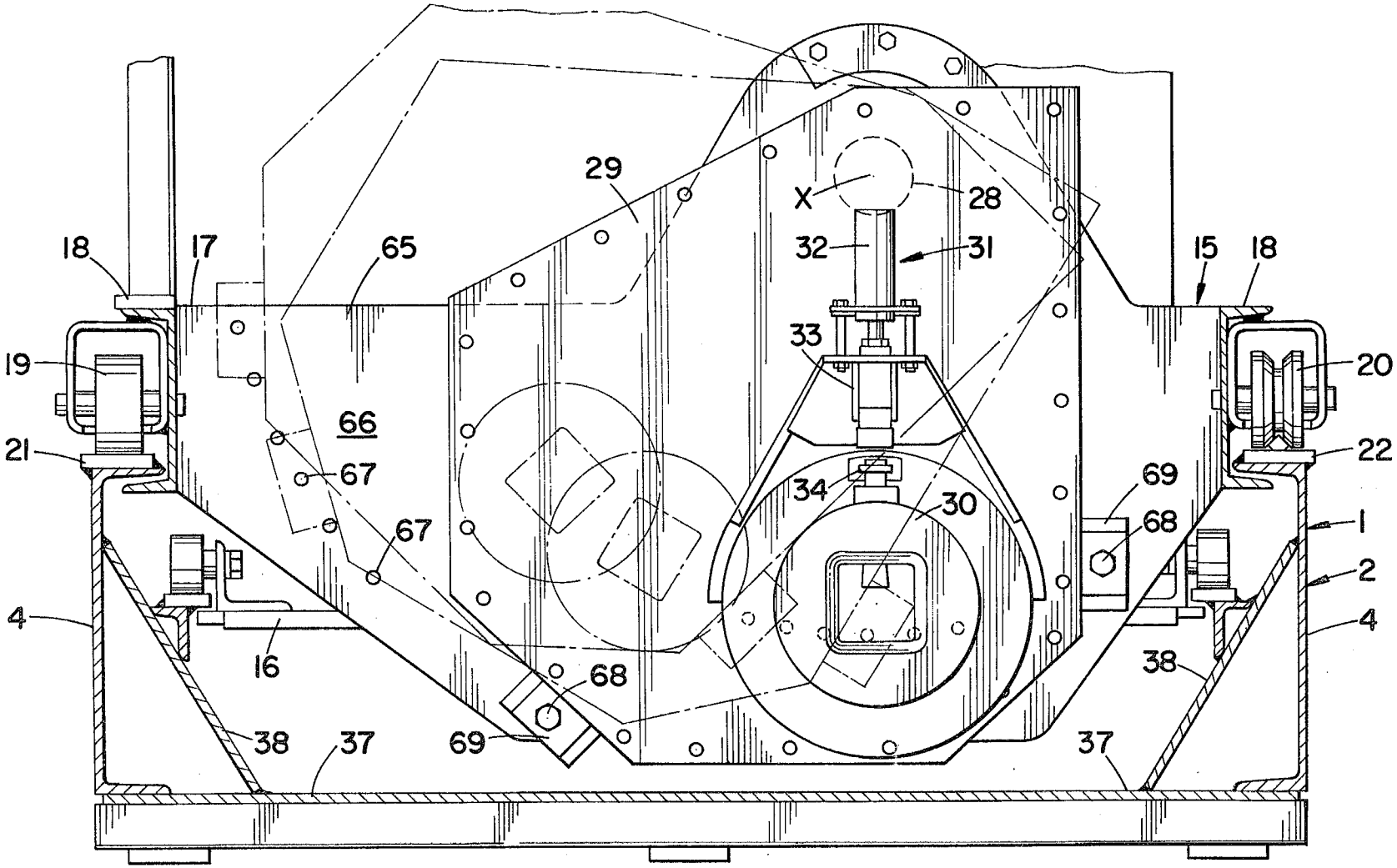
FIG. 9 is a section along line 9—9 of FIG. 3 but to a considerably larger scale.
Figure 10:
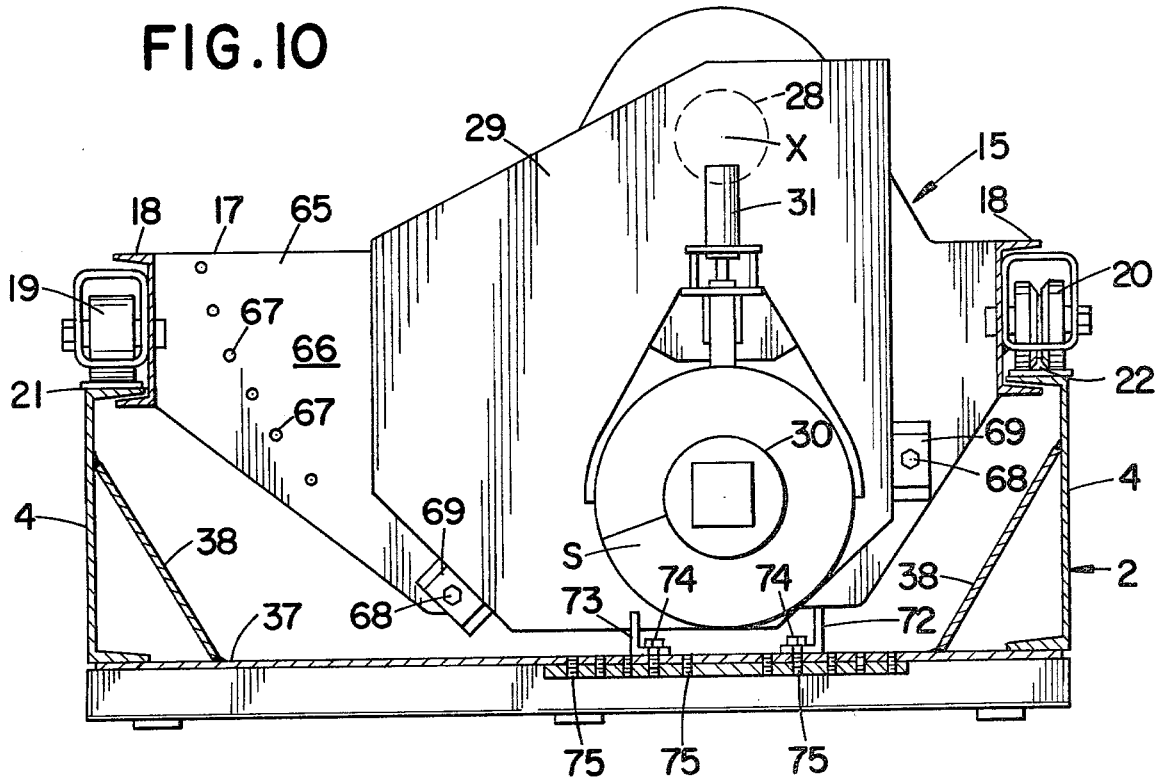
FIG. 10 is a section along line 10—10 of FIG. 3.

Lower frame portion 2 also supports a carriage 15 for guided movement longitudinally on beams 4, in suitable manner, by known means 16 (FIG. 9) between an extreme rearward position shown in full lines in the drawings and a forward position, to advance auger string A and cutting head C or to retract the carriage for insertion of additional auger sections S to lengthen the auger string. Carriage 15 comprises a rigid frame 17 having flanged side beams 18 carrying wheels 19, 20 that ride on guide portions 21, 22 on beams 4. Wheels 20 on one side of the carriage are grooved as shown and guide portion 22 is appropriately ridgeshaped in cross section to fit within the wheel groove so that the carriage is laterally guided on the frame. The outwardly extending lower flanges of side beams 18 of carriage 15 extend beneath the inwardly upper extending flanges of side beams 4 of the lower frame portion 2 and thus prevent carriag 15 from lifting off the lower frame portion (FIGS. 9, 10).

An internal combustion engine 23 constitutes the power source in the illustrated machine for rotating the auger string, and is fixed on frame 17 of carriage 15. Engine 23 drives through main power train means 24 comprising a known clutch 25, shiftable transmission means 26, known flexible coupling 27, drive shaft 28, and gear box 29, to rotate a drive head 30.

The power train means is compact and of exceptionally short overall length to provide a short as possibe overall length of carriage 15 and the auger machine as a whole. The apparatus also includes a known unlatching means 31 (FIGS. 9, 11) similar to that disclosed in U.S. Pat. No. 3,278,236 comprising a fluid cylinder 32 that moves means 33 to engage latch 34 on the drive head 30 that connects to and disconnects from the drive head the auger section S nearest the drive head. An operator on seat 35 can control, by known control means generally indicated by numeral 36, the operation of the carriage, power train means, and unlatching means.

Lower frame portion 2 includes a belly plate 37 fixed between and supported from side beams 4 by cross members 5. The belly plate has downwardly, inwardly converging side portions 38 and extends to the front ends of frame member 4, except where it is apertured at the cross conveyor described below. It supports in the machine the auger sections forming the auger string extending from drive head 30 up to the front portion of the machine near the earth wall into which the auger string penetrates in operation.

Coal mined by the cutting head is conveyed by the vanes of the auger string to a cross conveyor 40 extending across lower frame portion 2 near the front of the machine as described later. The coal is then deposited by conveyor 40 onto independently movable inclined auxiliary conveyor apparatus 41 from which it may be discharged into trucks or other conveyances for transportation away from the mining site.

The illustrated auger machine also includes auxiliary power means such as an internal combustion engine 42 and appurtenant pump means 43 for providing hydraulic fluid under pressure which through known means not shown is conveyed and controlled to actuate various portions of the machine such as the jacks, the skids, the conveyor 40, and the auxiliary conveyor apparatus 41, as later described.

Hoist means 44 is provided for moving auger sections into and out of the auger string, and will be described in more detail later.

The auger machine also includes at its front end, which in operation is adjacent the earth wall into which the auger penetrates, auxiliary guide means 45 that can be extended forwardly of the machine for a substantial distance, as shown in broken lines in FIG. 2, to bear against such wall to provide continuous support between the wall and belly plate 37 for the auger string and also continuous support for the coal that is mined and brought rearwardly by the vanes of the auger string to conveyor 40.

The illustrated machine rotates the auger string A, and hence the cutting head C, from the power source 24 through power train means 24 and gear box 29, while the carriage 15 is urged forward by means 16 to cause the cutting head to penetrate the coal or other material being mined. Auger sections S are inserted in the string and connected to the drive head 30 when the carriage 15 is located in its rearmost position in frame 1, to extend a length of the auger string as required to bore the hole deeper.

A highly advantageous feature of the apparatus of the invention is that front posts 7 containing front jacks 9 are located forwardly of cross conveyor 40, which extends across lower frame portion 2 below the auger string. The part of frame portion 2 through which passes the conveyor 40 is of low profile and not substantially higher than the remainder of frame portion 2, and the front jack posts 7 extend upwardly without any rear projections for the jacks, as in prior art auger machines.

Figure 3:
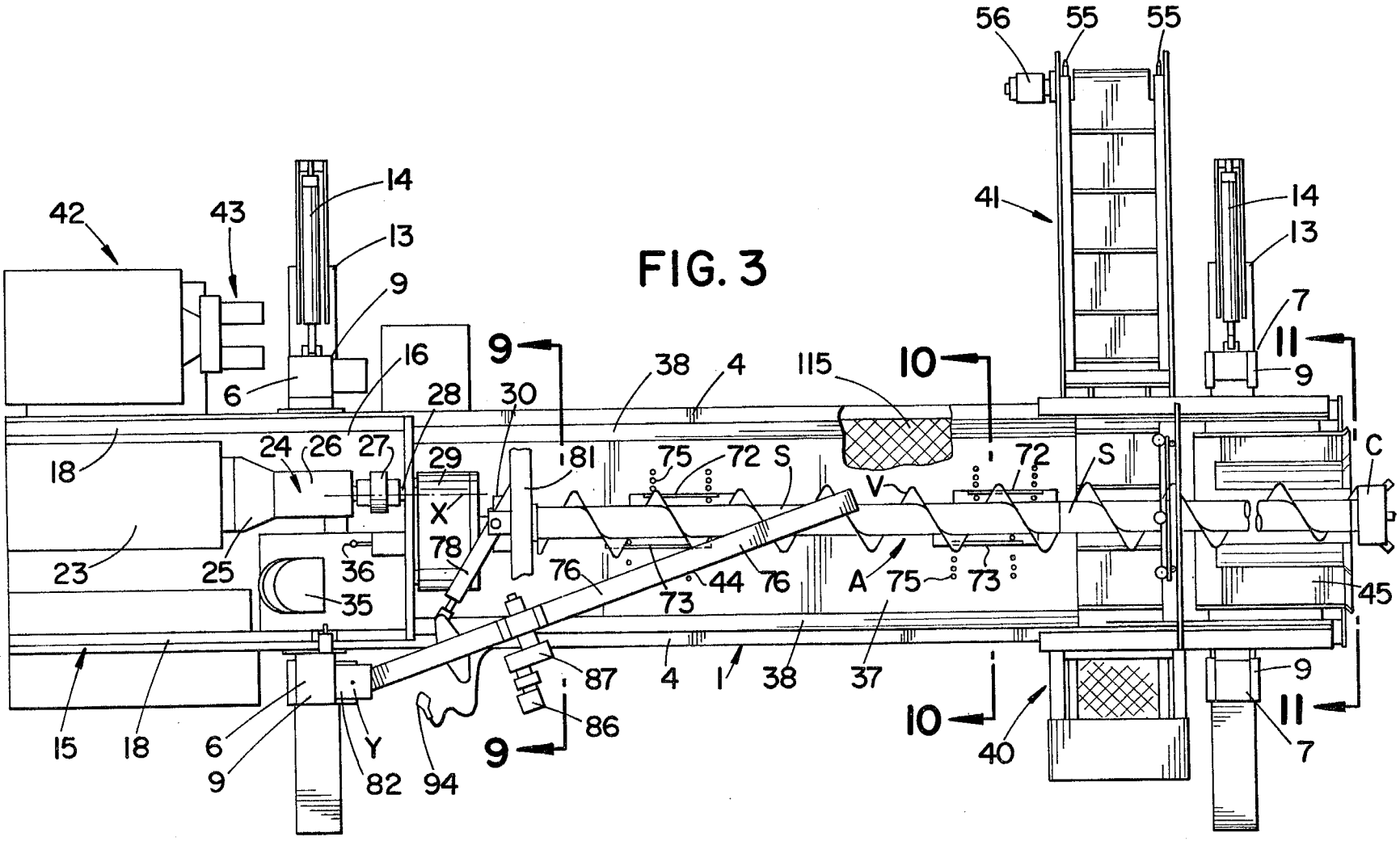
FIG. 3 is a plan of the machine of FIG. 2 to a slightly larger scale, the upper portion of the frame and the screen thereon being largely omitted for clarity.
Figure 4:
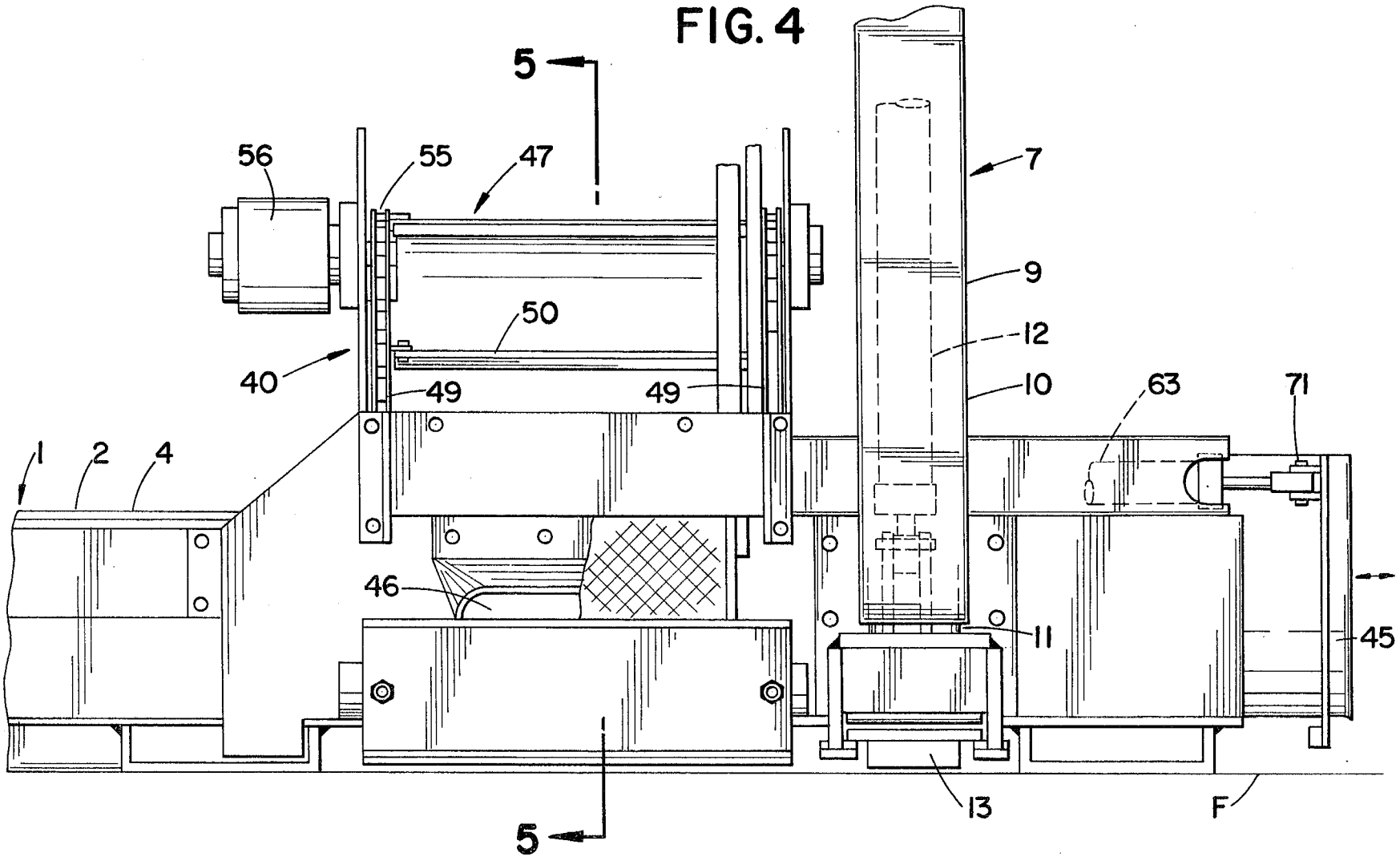
FIG. 4 is a detail to a larger scale of the lower front portion of the machine showing in particular a side view of the cross conveyor and movable front guide means.
Figure 5:
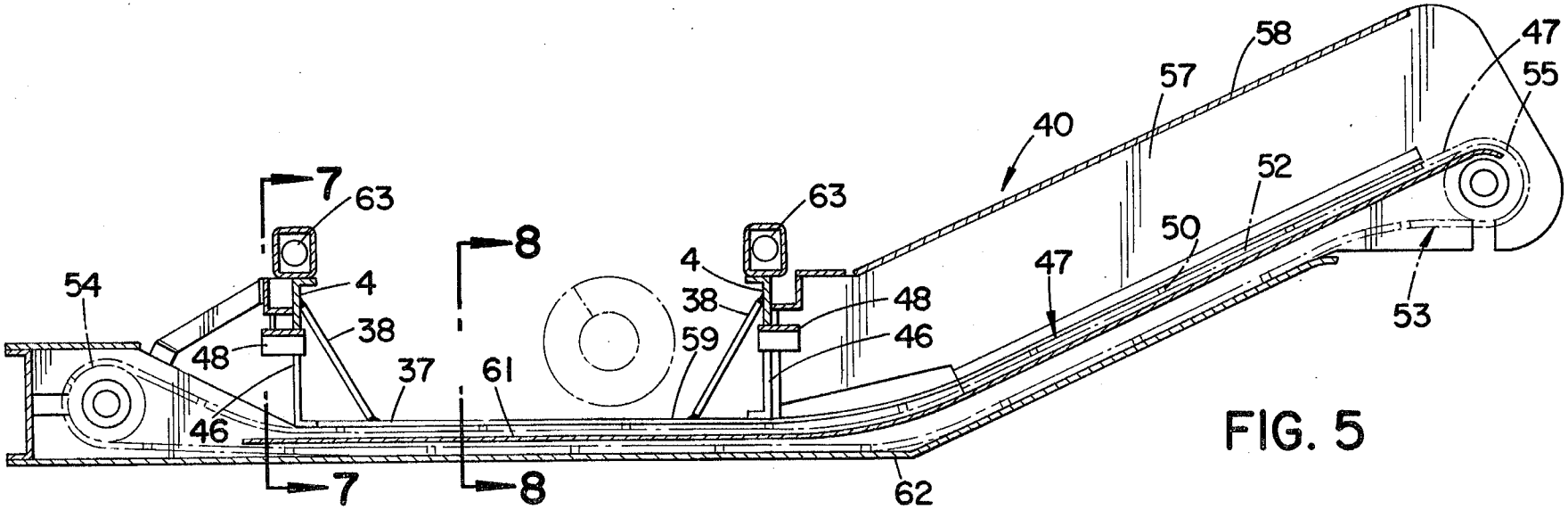
FIG. 5 is a sectional elevation along line 5—5 of the cross conveyor means of FIG. 4.
Figure 7:
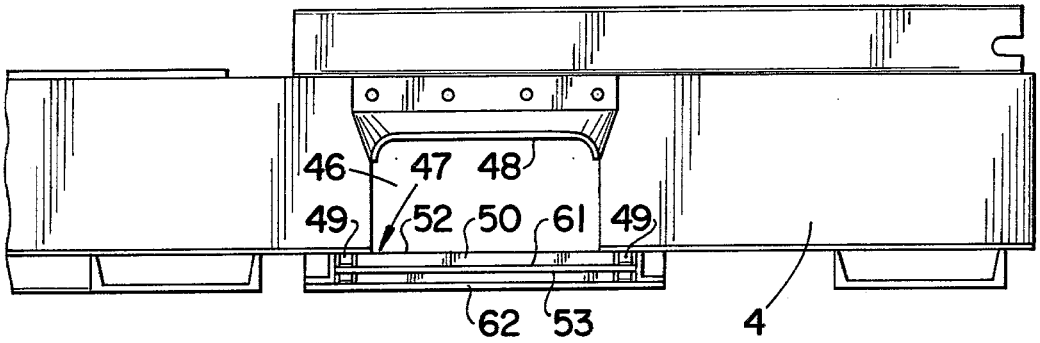
FIG. 7 is a section along line 7—7 of FIG. 5.
Figure 8:
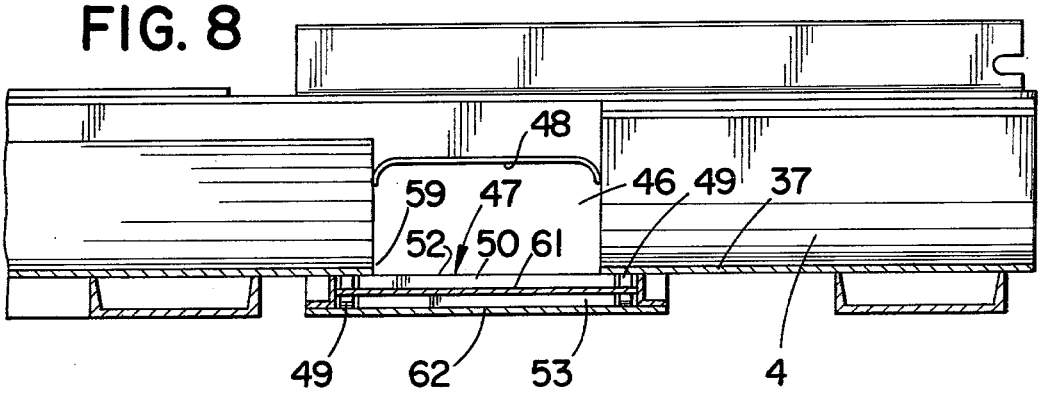
FIG. 8 is a section along line 8—8 of FIG. 5.
Figure 14:
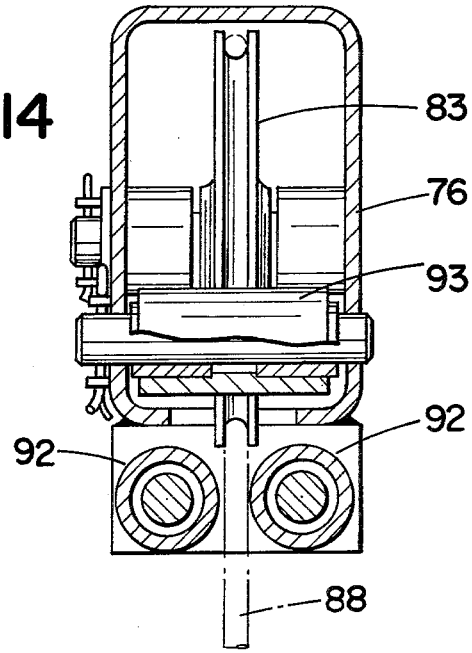
FIG. 14 is a detail along line 14—14 of FIG. 13 but to a larger scale showing the end sheave and associated guide rollers.

To achieve this, each of side beams 4 of frame portion 2 (FIGS. 5, 7, 8) has a recess 46 wide enough to have movable element 47 of conveyor 40 pass therethrough and of sufficient height to permit mined material on element 47 to pass laterally out of frame portion 2. Each beam 4 is reinforced in the vicinity of recess 46 by reinforcing means, including flanged reinforcing member 48 extending along the upper portion and partially at the sides of the recess. Movable conveyor element 47 is illustrated as of known type comprising endless flexible side chains 49 connected together by spaced parallel cross members 50 that do not extend above the tops and bottoms of the chains. The side chains pass over pairs of known sprockets 54 and 55 to provide upper and lower runs 52 and 53 of element 47, sprockets 55 being positively rotated by a suitable power unit such as fluid powered motor 56 (FIGS. 3, 4). Sprockets 54 are located at a level below the level of adjacent side beam 4 while the other pair of sprockets 55 are located at a considerably higher level to cause movable conveyor element 47 to convey mined material upwardly from the auger string to where the material can be dropped onto auxiliary conveyor 41. Elevated sprockets 55 are carried by side members 57 which also act as guides for the mined material until it is so discharged; members 57 are connected by an upper protective shield 58. The upper run 52 of the movable conveyor element passes below the level of the bottom of the belly plate 37 which has an aperture 59 through which mined material passing from the auger can drop onto the upper run of conveyor element 47.

A floor plate 61 (FIGS. 5, 7, 8) extends below the upper run and above the lower run of conveyor element 47 to support the mined material which is pushed along plate 61 by members 50 of conveyor element 47 to the location where the mined material is discharged from conveyor 40. Another floor plate 62 extends below the lower run to support it as it passes beneath frame members 4.

The machine is so designed that the cross conveyor 40 may be easily installed relatively to lower frame portion 2, so that the conveyor 40 may be installed to discharge on the other side of the machine.

Movable front auxiliary guide means 45 is adapted to be moved to its extended and retracted positions by a fluid powered cylinder 63 (FIGS. 4, 5, 11) at each side of guide means 45, the piston rod 64 of the cylinder being fixed to means 45 near its outer end. This guide means is adapted to be pushed outwardly until it presses against the wall into which the auger string penetrates. Guide means 45 is shaped to provide a guide recess R through which the auger extends. The bottom portion of this recess is essentially at the level of the top surface of belly plate 37 so that at all times the recess and belly plate support the augers in the auger string, and the recess also provides a passage closely fitting the sides and bottom of the auger string to ensure that the mined material moves rearwardly by the vanes V of the auger string and reaches cross conveyor 40, which carries it laterally out of the machine.

Figure 6:
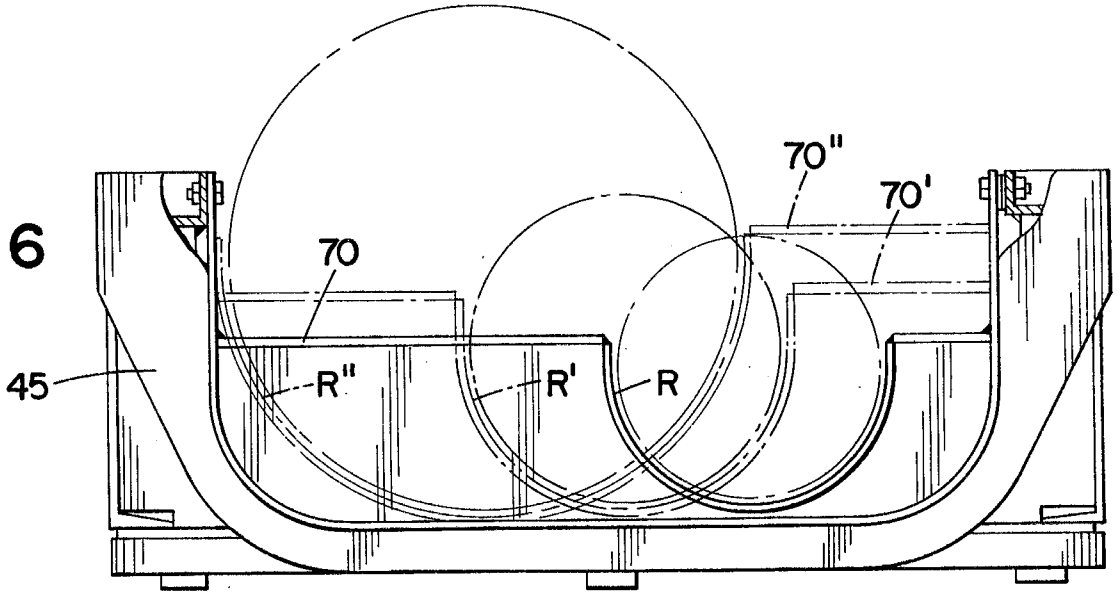
FIG. 6 is a view showing the front of the movable guide means at the front of the apparatus, showing in broken lines guide inserts for guiding augers of different diameters.
Figure 11:
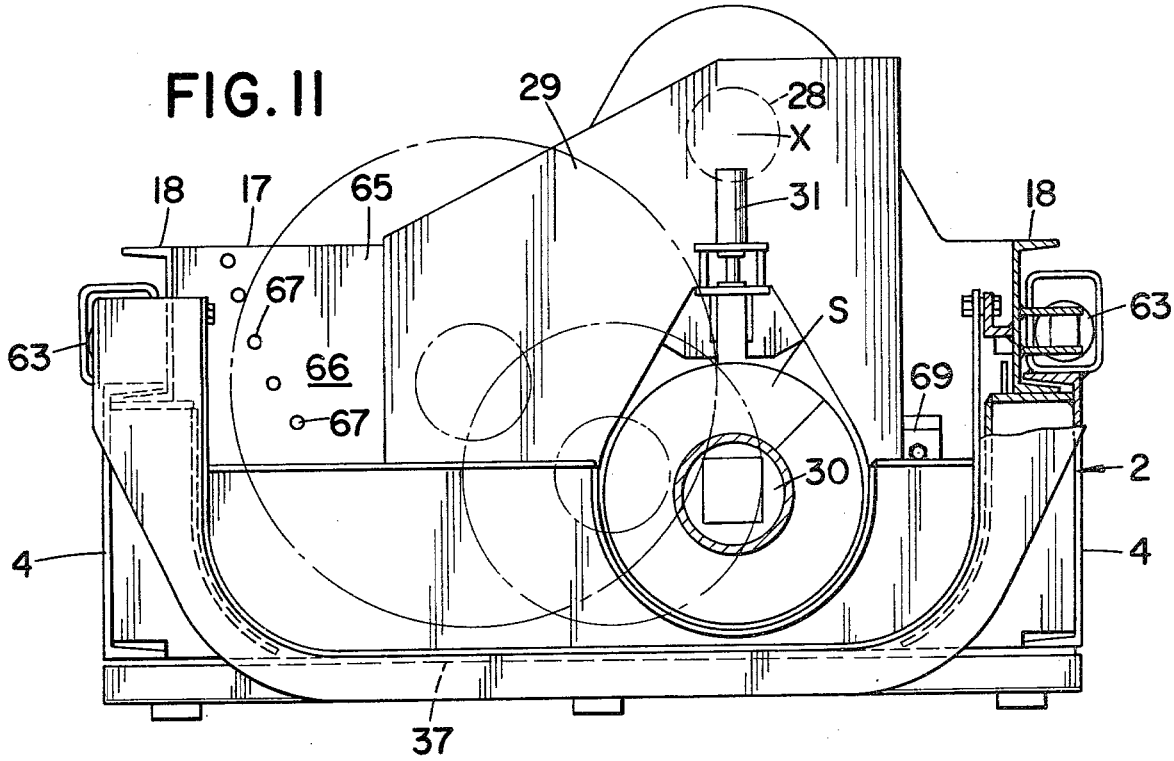
FIG. 11 is a view from line 11—11 of FIG. 3, showing in full lines an auger section of one diameter, and in broken lines showing positins of auger sections of other diameters that might be used in the illustrated machine.
Figure 12:
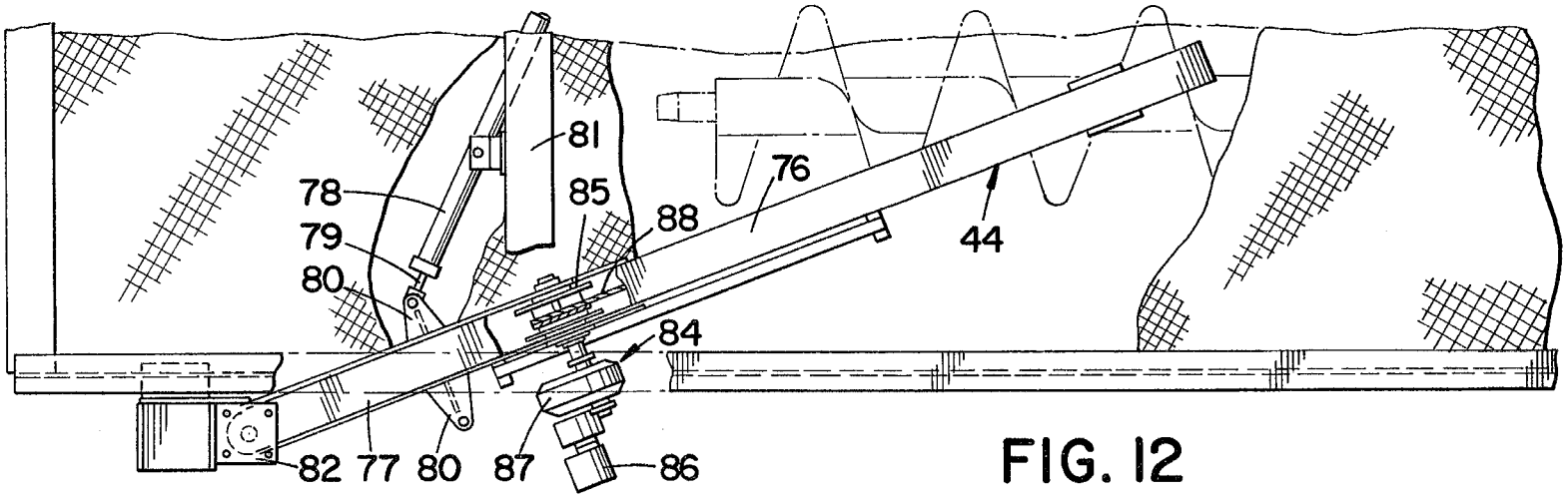
FIG. 12 is a detail of the machine showing, in plan, the hoist means.

Another advantageous feature of the machine illustrated is that it can be readily adapted to utilize augers of a wide range of different diameters. To make this possible, the gear box 29 is designed and constructed so that it can be pivotally adjustably swung about the axis X of the drive shaft 28 of the main power train 24 and secured in various positions, as shown in FIGS. 6, 9, 11, to enable it to drive augers of different diameters, without changing the elevation of the axis X of shaft 28 or of the power train 24 or engine 23 relative to the carriage 15 or the belly plate 37. For this purpose, a rigid supporting member 65 is fixed to side beams 18 of carriage 15 to extend transversely of the carriage 15. The front face 66 of member 65 is substantially flat and provided with spaced openings 67 adapted to be engaged by bolts 68 extending through openings in lugs 69 fixed to opposite lower edges of gear box 24. The upper end of the gear box is mounted on member 65 so that the gear box can be pivotally swung laterally about axis X of shaft 28. Openings 67 are located so that when gear box 29 is pivotally adjusted about axis X of shaft 28 it can accommodate augers of different diameters, bolts 68 extending through the appropriate openings 67 and having tightened nuts that secure gear box 29 in the proper position for the desired diameter of auger.

Axis X of shaft 28 is fixed on carriage 15, being located a substantial distance above the belly plate 37 and parallel to but offset a substantial distance laterally of the longitudinal center line of the space between beam 54 spanned by the belly plate. Since the relationship of the levels and lateral positions of axis X and the belly plate do not change even as the carriage moves longitudinally of beams 4, augers of different diameters will be located and supported at different positions laterally of the belly plate and the machine. The longitudinally movable auxiliary guide means 45 may be readily modified, as shown in FIG. 6, to correspond to the diameter and lateral location of an auger, to properly guide the auger and conduct material mined by such auger. This modification can be readily effected by replacing an existing insert 70 with another suitable insert 70' or 70'' having a recess R' or R'' of the proper diameter and proper lateral location. These inserts are secured in place, as by bolts, in the guide means 45.

Guide members 72, 73 are secured to belly plate 37 rearwardly of the cross conveyor 40 to guide the auger string laterally between drive head 30 and guide means 45. In the illustrated apparatus, these guide members are adjustably mounted by bolts 74 in suitably located threaded bolts 75 in the belly plate so that these guide members can be located in proper lateral distance apart and the proper lateral distance on the belly plate for auger strings of various diameters located at various positions laterally of the belly plate.

The hoist means 44 of the illustrated machine (FIGS. 1–3, 12, 13, 14) comprises an elongated, rigid, laterally extending boom 76 that is supported at one end for pivotal movement on an upright axis Y, the boom having side supporting plate 77 of considerable depth for stability. The boom is adapted to be moved in a generally horizontal plane by a fluid powered cylinder 78, the piston rod 79 of which is connected to one of two laterally extending lugs 80 fixed near the supported end of the boom and the cylinder of which is pivotally connected to a cross member 81 forming part of the upper frame portion 3 of the machine. The boom is pivotally supported on a laterally projecting supporting structure 82 fixed to the upper portion of one of the rear posts 6 containing a rear jack 9.

Figure 13:
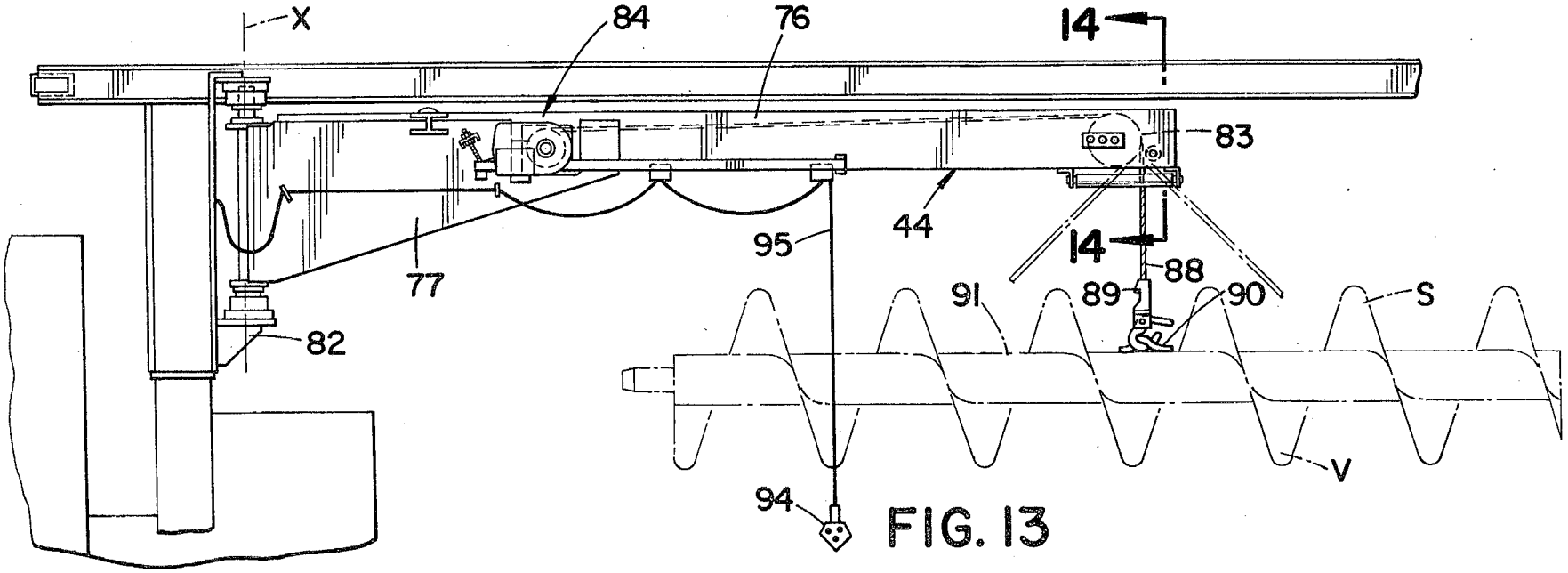
FIG. 13 is a side elevation of a portion of the machine showing a side elevation of the hoist means.

At its outer end, boom 76 carries a grooved freely rotatable sleeve 83 and near its supported end a winch 84. The winch comprises a drum 85 adapted to be positively rotated in either direction by a fluid powered motor 86 through a gear box 87. A cable 88 is adapted to be wound on and unwound from winch drum 84, and extends over sheave 83. At its free end the cable carries a closable hook structure 89 that can be hooked onto and unhooked from a loop member 90 fixed to the shaft 91 of an auger section S adjacent its center of gravity so that when the auger section is suspended from the cable as shown in FIG. 13, the auger section is balanced to be in a substantially horizontal position. Two rollers 92 are rotatably mounted longitudinally adjacent the end of the boom and sheave 83 to have the cable pass between them, and a roller 93 is rotatably mounted transversely of the boom adjacent sheave 83 to guide the cable laterally and prevent it from slipping out of the groove of the sheave.

A known manual control unit 94 (FIGS. 1, 3, 13) is connected to and suspended from electrical control cable 95 that is supported by the boom and connected to control the winch motor 86 and the fluid cylinder 78. By manual control from unit 94, the hoist apparatus can be operated so that hook structure 89 may be raised and lowered, and the boom can be swung laterally as required to place an auger section in the desired position in the machine for connection in an auger string in the machine, or to remove the auger section from the auger string.

Figure 15:
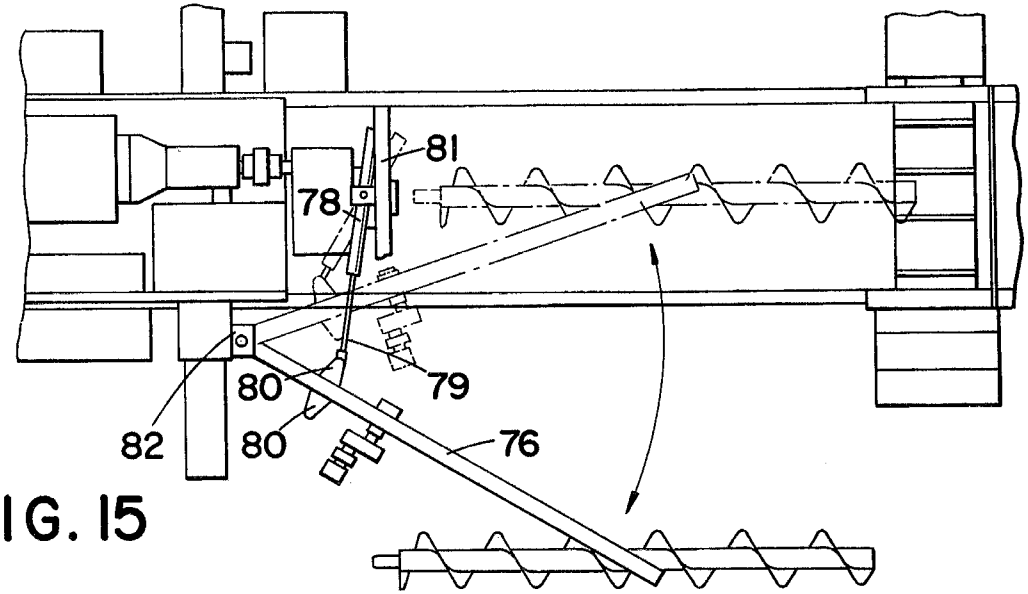
FIG. 15 is a plan view to a smaller scale showing a range of motions of the hoist means while carrying auger sections.
Figure 16:
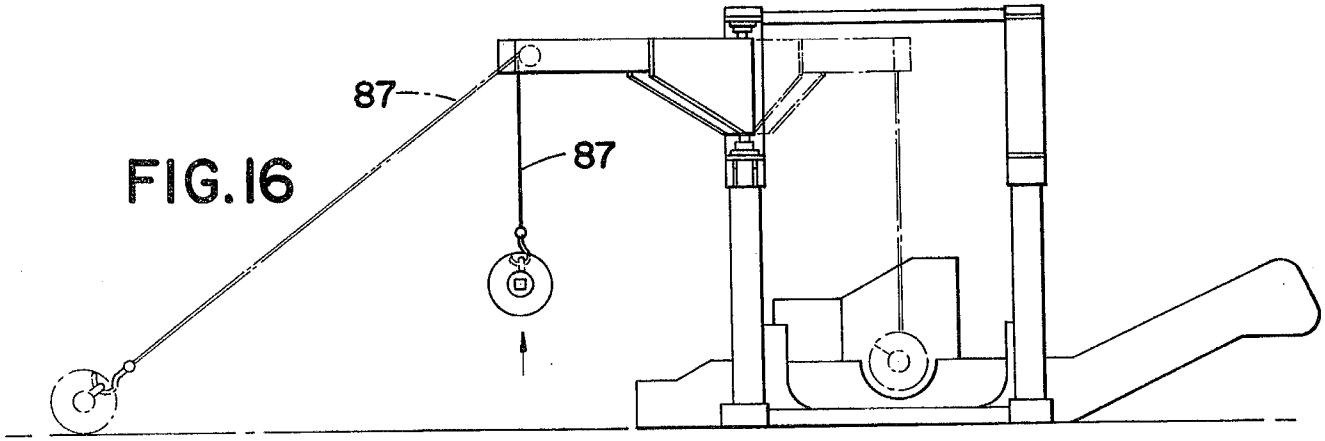
FIG. 16 is a somewhat diagrammatic plan view of the apparatus showing how the hoist means can move auger sections from a distance to be placed in the auger machine.

The hoist means is such that it (FIGS. 15, 16) can move an auger section from a considerable position away from the machine to install it in an auger string in the machine, or to move an auger section from the auger string and place it at a considerable distance from the machine as on a conveyance or on the ground. Moreover, the hoist means is such that even if the auger section is not located below the boom when it is swung to its outermost position away from the machine, the hoist means can drag an auger section from the ground to a positon where it can be lifted as shown in FIG. 16.

The machine is so designed that it has hoist boom supporting structure 82 on the post 6 on the other side of the apparatus, so that boom 76 may be easily mounted on the other side of the apparatus as required for convenience in operation. The fluid cylinder 78 for moving the boom laterally is so pivotally connected and supported that it may be swung to a position in which its piston rod 79 may be attached to the appropriate lug 80 on the boom when the boom is mounted on the other side of the apparatus.

Figure 18:
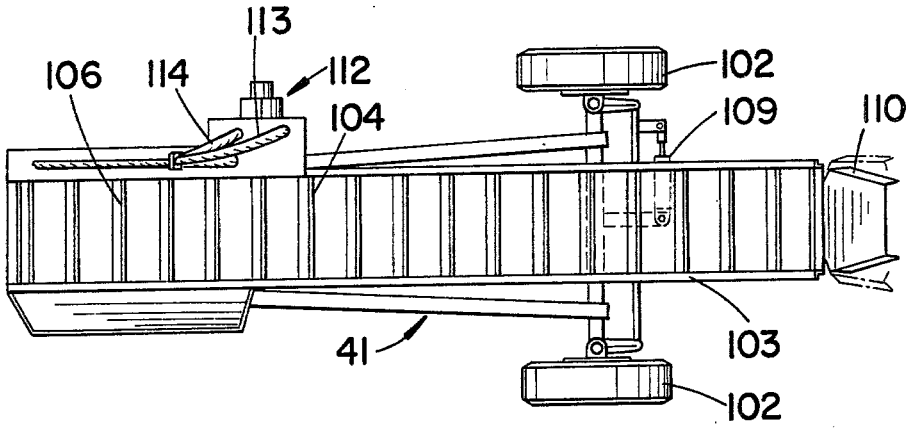
FIG. 18 is a plan of the apparatus of FIG. 17.
Figure 17:
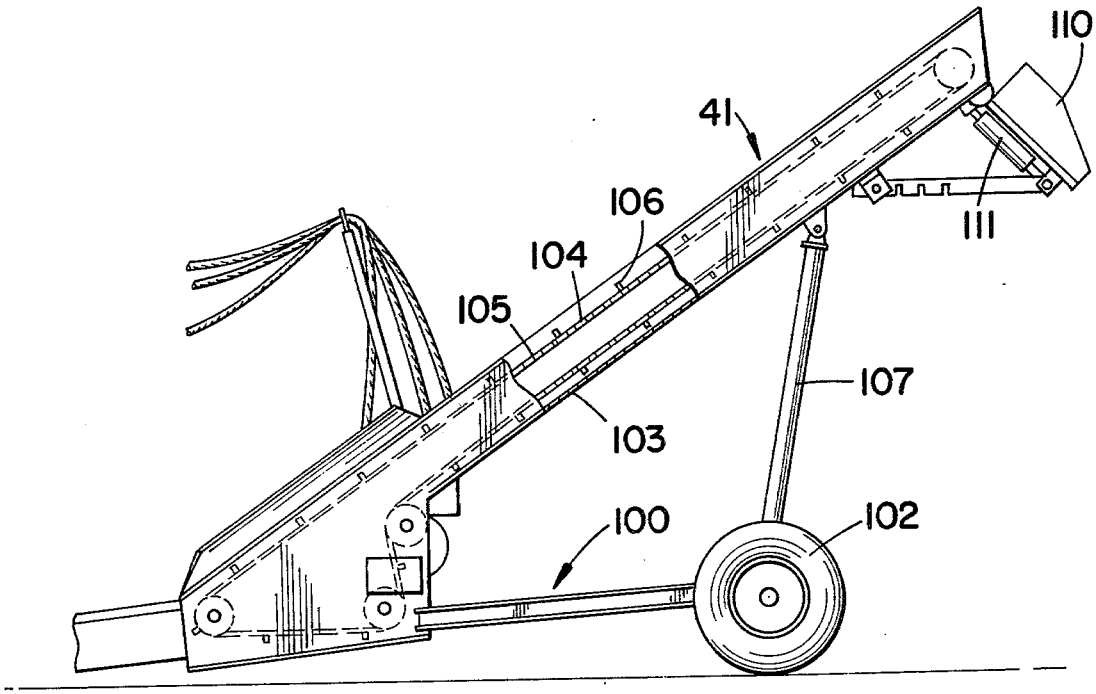
FIG. 17 is a side view of inclined annular conveyor apparatus for conveying mined material away from the auger machine to a conveyance such as a truck.

The illustrated auxiliary conveyor apparatus 41 (FIGS. 1, 17, 18) comprises a frame 100 having wheels 102 which may be freely rotatable as shown, or power-driven if desired. Frame 100 carries an inclined trough-shaped conveyor chute 103 in which travels a power-driven movable conveyor element 104 which comprises side chains 105 and cross slats 106. The chute is connected at its lower end to frame 100 at a location where the chute and the movable conveyor element in it can receive mined material dropping from the elevated end of the cross conveyor 40 of the auger machine when conveyor apparatus 41 is properly located. Near its other end, the chute 103 is supported by telescoping supporting members 107 and adapted to be raised and lowered by a fluid cylinder 108. Wheels 102 are steerable, preferably being adapted to be steered by fluid power element 109. The upper end of chute 103 has a movable chute section 110 that is pivotally connected at one end so that its free end can be raised and lowered, and so that its free end can be moved laterally by a fluid cylinder 111, to direct discharged material precisely where it is desired. The movable element 104 is driven by a fluid-powered motor 112.

All of the fluid powered elements for driving movable conveyor element 104, operating the steering mechanism, for raising and lowering the chute 103, and for adjusting the position of the chute section 110 are supplied with pressurized fluid through supply conduit 113 and return conduit 114 connected to the pressurized fluid supply unit 43 on the auger machine by demountable connections. The various valves that control the fluid power elements may be controlled from the controls adjacent the operator's seat 35 or from controls mounted on the auxiliary conveyor itself.

The illustrated apparatus provides for added safety of personnel by a protective screen 115 fixed to the upper frame portion 3 to prevent debris from dropping into the apparatus and the operator in seat 35, and also by a downwardly extending inclined screen 116 on the front posts 7 to protect personnel at that location.

The machine is so designed that skids 13 are demountable, and after removal of the skids, cross conveyor 40, and auxiliary conveyor apparatus 41, the remaining portion of the apparatus may be narrow enough to be transported over highways and satisfy legal requirements.

Moreover, the illustrated machine is provided with brackets 117 by which removable transporting wheels 118 can be mounted to permit the machine to be moved readily by being towed.

It is apparent that the illustrated machine can be readily adjusted to handle augers of widely different diameters as from 16 to 30 inches with a minimum of labor and down time. This makes possible rapid maximum recovery of coal or other mined material from seams of different thicknesses by drilling to depths of as much as 150 feet or more. Although in the illustrated machine the use of augers of three different diameters is illustrated, it is apparent that by suitable modification and adjustment, augers of a greater or lesser number of different diameters can be used.

Unique and important advantages arise from the fact that the gearbox 29 is pivotally adjustable about axis X which is located not only above but laterally offset a substantial distance from the center line of the space between the side beams 4 that is spanned by belly plate 37. The amount of lateral offset is such that when the smallest diameter auger for which the machine is designed is connected to drive head 30 the axis of such auger is directly below axis X and is near one side of the belly plate, and when the largest diameter auger for which the machine is designed is connected to drive head 30 the auger is near the other side of the belly plate 37, augers of intermediate diameters being located between said positions, as is apparent from FIGS. 6 and 9. The laterally offset position of axis X therefore makes it possible for augers of a wide range of diameters, even of relatively large diameters, to be used in a machine of relatively narrow width, since all augers of all sizes larger than the smallest auger when connected to drive head 30 are located to the side of axis X that is farthest from one side of the belly plate and the corresponding beam 4. If the pivot axis X was not thus laterally offset, and was located centrally above the belly plate, a considerably wider machine would be necessary to accommodate augers of different diameters.

Moreover, the location of axis X, which is the axis of the drive shaft 28 on carriage 15, causes the power train means 24 in the carriage to be located to one side of the machine, so that the operator's seat 35 from which he can handle control means 36 can be located alongside the power train means and not over it, so the operator can view necessary parts of the machine for operation but not be at a considerable height. This feature also makes it possible to make the auger machine narrow, and also low in height, even sufficiently narrow and low to permit the machine to be readily transported by truck over highways while complying with legal requirements, after removal of the skids 13 and cross conveyor 40.

The cross conveyor, the hoist means, and the skids are de-mountable and can be mounted for use at either side of the machine, thus aiding in making possible great flexibility of operation of the machine.

Furthermore, the fact that the front jacks 9 are located forwardly of cross conveyor 40 facilitates placing auger sections in the auger string and removing them from the auger string, and makes possible a boom type hoist means like that illustrated which is low in cost and simple and rapid in operation. These advantages arise because the height to which the auger section must be lifted is low since it is not necessary to lift the auger section to a substantial height to clear any jack and because it is not necessary to move the lifted auger section longitudinally to clear any jack as the auger section is moved laterally into or away from the lower frame portion 2 since the distance between the boom pivot axis Y and the portion of cable 88 passing downwardly from sheave 83 is such that when carriage 15 is in its rearmost position and the hook support 89 is over the auger string in the machine an auger section carried by the hook support is in the proper position longitudinally of the machine to be connected to or disconnected from drive head 30. Therefore, the time required for inserting an auger section into the auger string or removing it from the string is substantially reduced over that heretofore required, with a consequent reduction in labor costs and an increase in production. Furthermore, since the auger section is automatically in the proper longitudinally and rotational positions for connection to or disconnection from the auger string, it is not necessary for an operator to manually contact the auger section, so that safety and speed of operation are greatly increased for this reason. Moreover, these advantages of the hoist means make it possible for only a single operator to control handling of auger sections so that two-man operation of the machine is possible.

An auger section can thus be safely and properly moved while no operator is near to place it in or remove it from the auger string, with substantially increased speed and a consequent reduction in labor costs and increase in production.

Furthermore, the location of the front jacks forwardly of the cross conveyor, for reasons apparent from the preceding discussion, also aids in making is possible for the machine to be made of sufficiently low height to permit it to be legally transported over public highways by truck after removal of the skids and cross conveyor.

For the above-discussed and other reasons, the design of the machine is such that the cost of manufacture and the weight of the machine are lowered. The lower weight reduces problems of transporting the machine from one mining location to another and avoids problems that might arise from overweight loading of highways.

Moreover, since the illustrated auger machine is short in length as compared to other prior auger machines for the reasons indicated above, and since there is only a very small distance between the pit floor on which the machine rests when the jacks are retracted and the bottom edges of the auger vanes or cutting head, the depth and width of the floor that must be cut to form a pit to permit the auger machine to operate against the wall containing a seam of material to be mined are substantially reduced. This substantially reduces the amount of material to be excavated, the cost of excavating the pit and establishing the floor particularly when rocky or hard material is encountered, and the cost of backfilling to meet ecological requirements because considerably less excavation is required.

All of these factors reduce costs of manufacture, operating and transporting the machine, and hence the costs of mining.

Apparatus embodying the invention may be used for purposes other than mining coal.

Various modifications apparent to those skilled in the art in addition to those indicated above may be made in the apparatus and methods indicated above, and changes may be made with respect to the features disclosed, provided that the elements or steps set forth in the claims hereof or the equivalents of such be employed.

What is claimed is:

1. Auger apparatus comprising a rigid frame including a generally horizontally and longitudinally extending lower frame portion having a front end and a rear end, said lower frame portion comprising spaced parallel frame members at the sides of said frame portion; power means carried by said lower frame portion adapted to rotate elongated auger means about the axis of said auger means while it is positioned in an operative location in said auger apparatus between said frame members of said lower frame portion, the axis of said auger means extending generally parallel to said frame members; spaced upright members fixed to said lower frame portion near the front end thereof, each of said upright members comprising jack means for raising and lowering said lower frame portion; conveyor means located near the front end of said lower frame portion but rearwardly of said upright members, said conveyor means extending transversely beneath said auger means when it is in place between said frame members of said lower frame portion to receive mined material conveyed to said conveyor means by said auger means as it rotates and to convey said mined material laterally out of said lower frame portion, said frame members of said lower frame portion being recessed upwardly from the lower edge thereof to provide clearance for said conveyor means and mined material conveyed thereby, and means for driving said conveyor means.

2. The apparatus of claim 1, in which said conveyor means comprises an endless movable element, and rotatable members outside of said lower frame portion over which said endless movable element travels.

3. The apparatus of claim 1, in which said conveyor means is immediately adjacent said upright members.

4. The apparatus of claim 1, in which the lower frame structure immediately above the part of the lower frame portion at which said conveyor means is located is free of any projection that extends a substantial distance above the remainder of said lower frame portion, so that an auger section moved toward or from the position occupied by said auger means need be lifted only a relatively short distance above said lower frame portion to clear said lower frame portion.

5. The apparatus of claim 1, comprising hoist means for moving an auger section toward or away from said auger means, said hoist means being supported near the rear of said lower frame portion and comprising boom means adapted to be moved laterally between a position to be occupied by auger means between the frame members of said lower frame portion and a position outside of said lower frame portion, cable means carried by said boom means and suspending auger section engaging means adapted to be raised and lowered by said cable means; and means adapted to shorten and lengthen said cable means to permit said auger section engaging means to be raised and lowered, said boom means being sized and supported to cause said cable to suspend an auger section in proper position longitudinally of said lower frame portion to be connected to said power means when said auger section is lowered to the position to be occupied by said auger means.

6. Auger apparatus comprising a rigid frame including a generally horizontally and longitudinally extending lower frame portion having a front end and a rear end, said lower frame portion comprising spaced parallel frame members at the sides of said frame portion; power means carried by said lower frame portion adapted to rotate elongated auger means about the axis of said auger means while it is positioned in an operative location in said auger apparatus between said frame members of said lower frame portion, the axis of said auger means extending generally parallel to said frame members; belly means between said frame members of said lower frame portion, said belly means being adapted to support said auger means thereon, carriage means embodying said power means adapted to move longitudinally of said lower frame portion on said frame members of said lower frame portion, and drive means carried by said carriage means and capable of lateral movement thereon and adapted to drive said auger means in any of a plurality of positions located laterally between said frame members, and on said belly means spaced upright members fixed to said lower frame portion near the front end thereof, each of said upright members comprising jack means for raising and lowering said lower frame portion; conveyor means located near the front end of said lower frame portion but rearwardly of said upright members, said conveyor means extending transversely beneath said auger means when it is in place between said frame members of said lower frame portion to receive mined material conveyed to said conveyor means by said auger means as it rotates and to convey said mined material laterally out of said lower frame portion; and means for driving said conveyor means.

7. The apparatus of claim 6, in which said laterally movable drive means is pivotally mounted at its upper portion on said carriage to permit pivotal movement of its lower portion containing a rotatable drive head for said auger means.

8. The apparatus of claim 6, in which said belly means comprises adjustable guide means for locating an auger string laterally thereof in any of a plurality of lateral positions.

9. The apparatus of claim 6, in which said lower frame portion contains at its front end guide means adapted to be moved longitudinally of said frame member, and removable guide portion means in said guide means adapted to be removed and replaced by other guide portion means to accommodate augers of different diameters in different positions laterally of said lower frame portion.

10. Auger apparatus comprising a rigid frame including a generally horizontally extending lower portion having a front and rear end, said lower frame portion comprising spaced parallel generally longitudinally extending frame members and belly means extending transversely between the lower portions of said frame members; carriage means supported by said lower frame portion and adapted to move longitudinally of said frame members, said carriage means including power means and drive means from said power means to a drive head adapted to be connected to and to rotate an auger string comprising at least one auger section, said auger string being adapted to be supported by said belly means; movable drive means included in said drive means on said carriage means and adapted to carry said drive head and to move said drive head laterally of said carriage means to drive an auger string in any of several positions located laterally of and extending longitudinally of said frame members; guide means adapted to be fixed to said belly means in any of several positions laterally of said belly means between said frame members to guide an auger string in any of said several lateral positions between said lower frame members; and movable guide means movable longitudinally of said frame portion at the front end thereof to permit said guide means to extend between said lower frame portion and the wall in which the auger is to penetrate, said longitudinally movable guide means including guide portion means adapted to be adjusted to fit, support and guide auger strings located in said different positions.

11. The apparatus of claim 10, in which said movable drive means is pivotally supported at its upper portion on said carriage about an axis substantially above and substantially parallel to said belly means, said movable drive means including said drive head at its lower portion, said movable drive means being adapted to be moved about said pivot axis to locate said drive head in a plurality of positions laterally of said belly means to accommodate auger strings of different diameters at different lateral positions relative to said belly means.

12. Auger apparatus comprising a rigid frame including a generally horizontally extending lower portion having a front and rear end, said lower frame portion comprising spaced parallel generally longitudinally extending frame members and belly means extending transversely between the lower portions of said frame members; carriage means supported by said lower frame portion and adapted to move longitudinally of said frame members, said carriage means including power means and drive means from said power means to a drive head adapted to be connected to and to rotate an auger string comprising at least one auger section, said auger string being adapted to be supported by said belly means; movable drive means included in said drive means on said carriage means and adapted to carry said drive head and to move said drive head laterally of said carriage means to drive an auger string in any of several positions located laterally of and extending longitudinally of said frame members; guide means adapted to be fixed to said belly means in any of several positions laterally of said belly means between said frame members to guide an auger string in any of said several lateral positions between said lower frame members; movable guide means movable longitudinally of said frame portion at the front end thereof to permit said guide means to extend between said auger frame portion and the wall in which the auger is to penetrate, said longitudinally movable guide means including guide portion means adapted to be adjusted to fit, support and guide auger strings located in said different positions; spaced upright members fixed to said lower frame portion near the front end thereof, each of said upright members comprising jack means for raising and lowering said lower frame portion; conveyor means located near the front end of said lower frame portion but rearwardly of said upright members, said conveyor means extending transversely beneath said auger means when it is in place between said frame members of said lower frame portion to receive mined material conveyed to said conveyor means by said auger means as it rotates and to convey said mined material laterally out of said lower frame portion; and means for driving said cross conveyor means.

13. The apparatus of claim 12, in which said movable drive means is pivotally supported at its upper end portion on said carriage about an axis substantially above and substantially parallel to said belly means, said movable drive means including said drive head at its lower portion, said movable drive means being adapted to be moved about said pivot axis to locate said drive head in a plurality of positions laterally of said belly means to accommodate auger strings of different diameters at different lateral positions relative to said belly means.

14. The apparatus of either claim 12 or claim 13, in which said frame members of said lower frame portion are recessed upwardly from the lower edge thereof to provide clearance for said conveyor means and mined materials conveyed thereby.

15. The apparatus of either claim 12 or claim 13, in which said cross conveyor means comprises an endless movable element, and rotatable members outside of said lower frame portion over which said endless movable element travels.

16. The apparatus of either claim 12 or claim 13, in which said belly means comprises adjustable guide means for locating an auger string laterally thereof in any of a plurality of lateral positions.

17. The apparatus of either claim 12 or claim 13, in which said lower frame portion contains at its front end guide means adapted to be moved longitudinally of said frame member, and removable guide portion means in said guide means adapted to be removed and replaced by other guide portion means to accommodate augers of different diameters in different positions laterally of said lower frame portion.

18. Auger apparatus comprising a rigid frame including a generally horizontally extending lower portion comprising spaced and generally longitudinally extending frame members and belly means extending transversely between said frame members; carriage means supported by said lower frame portion and adapted to move longitudinally of said frame members, said carriage means including power means and drive means from said power means to a drive head adapted to be connected to and to rotate an auger string comprising at least one auger section, said auger string being adapted to be supported by said belly means; movable drive means included in said drive means on said carriage means and adapted to carry said drive head, said movable drive means being pivotally mounted on said carriage means about an axis that is substantially above and that is laterally offset relative to said longitudinally extending frame members and said belly means by a substantial distance from the center line of the space between said frame members and of said belly means, said movable drive means being adapted to adjustably position said drive head laterally of said carriage means to drive an auger string of any one of a plurality of diameters in any of a plurality of positions located laterally of and extending longitudinally of said frame members; and seat means for seating an operator adjacent but not over said drive means on said carriage means in a position where he can control operation of said carriage means and other parts of the apparatus.

19. The apparatus of claim 18 in which said movable drive means is pivotally mounted on said carriage means about said axis in a position such that an auger of the smallest diameter adapted to be driven by said drive head is located substantially below said axis while all augers of larger diameter adapted to be driven by said drive head when it is located to the side of said pivot axis that is farathest from either of said frame members.

* * * * *

UNITED STATES PATENT AND TRADEMARK OFFICE

CERTIFICATE OF CORRECTION

PATENT NO. : 4,264,106

DATED : April 28, 1981

INVENTOR(S) : Ronald C. Deeter, Thad A. Lora, Warren E. Kelm

It is certified that error appears in the above-identified patent and that said Letters Patent are hereby corrected as shown below:

In the Abstract, last line, after "efficient" insert --and easily operable hoist means of simplified construction. The mining machine is capable of being readily adjusted to drive augers of a wide range of diameters.--.

Column 2, line 24, after "movement" insert --of--;
line 50, change "oftend" to --often--.
Column 5, line 1, change "positins" to --positions--;
line 47, change "more" to --move--.
Column 7, line 9, change "24" to --23--.
Column 8, line 36, change "24" to --29--.
Column 9, line 22, change "sleeve" to --sheave--.
Column 16, line 56, change "farathest" to --farthest--.

Signed and Sealed this

*Eighteenth* Day of *August 1981*

[SEAL]

*Attest:*

GERALD J. MOSSINGHOFF

*Attesting Officer*

*Commissioner of Patents and Trademarks*